US010077957B1

(12) United States Patent
Aguf

(10) Patent No.: US 10,077,957 B1
(45) Date of Patent: Sep. 18, 2018

(54) BREECH BLOCK FOR FIREARMS

(71) Applicant: Evgeny Aguf, Cologne (DE)

(72) Inventor: Evgeny Aguf, Cologne (DE)

( * ) Notice: Subject to any disclaimer, the term of this patent is extended or adjusted under 35 U.S.C. 154(b) by 0 days.

(21) Appl. No.: 15/486,478

(22) Filed: Apr. 13, 2017

(51) Int. Cl.
*F41A 3/20* (2006.01)
*F41A 3/72* (2006.01)

(52) U.S. Cl.
CPC . *F41A 3/20* (2013.01); *F41A 3/72* (2013.01)

(58) Field of Classification Search
CPC ..... F41A 3/20; F41A 3/72; F41A 3/18
USPC ..... 42/16
See application file for complete search history.

(56) References Cited

U.S. PATENT DOCUMENTS 1,568,635 A * 1/1926 Speer ..... F41A 3/20 42/16
3,257,749 A * 6/1966 Donaldson ..... F41A 3/42 42/16
4,547,988 A * 10/1985 Nilsson ..... F41A 3/18 42/16
4,672,762 A * 6/1987 Nilsson ..... F41A 3/20 42/16
6,279,258 B1 * 8/2001 Hashman ..... F41A 3/20 42/16
6,393,961 B1 * 5/2002 Ockenfuss ..... F41A 3/20 42/16
2005/0217473 A1 * 10/2005 Murello ..... F41A 3/40 89/187.01
2005/0241471 A1 * 11/2005 Murello ..... F41A 3/48 89/185
2011/0061523 A1 * 3/2011 Webb ..... F41A 3/42 89/128
2014/0311005 A1 * 10/2014 Tertin ..... F41A 3/20 42/16

FOREIGN PATENT DOCUMENTS

DE 4305700 C1 * 10/1994 ..... F41A 3/42
DE 19608872 C1 * 6/1997 ..... F41A 3/46
DE 102007043628 A1 * 3/2009 ..... F41A 17/62
DE 102006036437 B4 * 1/2010 ..... F41A 9/38
DE 102016120891 A1 * 5/2017 ..... F41A 3/20
EP 0784194 A2 * 7/1997 ..... F41A 3/20
GB 2493002 A * 1/2013 ..... F41A 17/64

* cited by examiner

*Primary Examiner* — John Cooper
(74) *Attorney, Agent, or Firm* — Maine Cernota & Rardin

(57) ABSTRACT

The present invention relates to a breech block for firearms, particularly for repeating firearms, comprising a cartridge chamber, an external case and a bolt accommodated therein, wherein the bolt features a breech head in the region facing the cartridge chamber and a control piece is arranged within the bolt such that it can be axially displaced relative to the bolt and relative to the breech head, with said breech block furthermore comprising a bolt lever that is connected to the control piece such that the breech head is unlocked during a backward motion and locked during a forward motion of the bolt lever, wherein the bolt lever is pivotably mounted in the rear end region of the case and the bolt lever can be pivoted about an axis that extends eccentric to the longitudinal axis of the bolt, wherein the control piece is according to the invention connected to the bolt lever by means of an intermediate piece, which protrudes radially outward from the bolt, the breech head is mounted in the bolt such that it is rotatable about its axis, and the breech head is rotated by axially displacing the control piece.

11 Claims, 8 Drawing Sheets

Section A-A

3
A-A 24
3
A
A
17
6

3
17
6

3
17
6

3
17
6
26

BREECH BLOCK FOR FIREARMS

FIELD OF THE INVENTION

The invention relates to firearms, and more particularly, to breech blocks for repeating firearms.

BACKGROUND OF THE INVENTION

DE 196 08 872 C1 discloses a breech block for firearms, particularly for repeating firearms, with a cartridge chamber, an external case and a bolt accommodated therein, wherein the bolt features a breech head in the region facing the cartridge chamber and a control piece is arranged within the bolt such that the breech head is unlocked during a backward motion and locked during a forward motion of the bolt lever. However, the breech head is not rotatably mounted in this known breech block. The lock is realized by means of locking elements in the form of balls that are pressed outward against the inner wall of the breech case by a beveled front end face of the control piece during its forward displacement. Although the bolt lever of this firearm has an advantageous rear position, the lock realized by means of the aforementioned balls proved disadvantageous in practical applications.

EP 0 784 194 A2 describes a straight-pull breech block for a firearm, in which the breech head is rotatably mounted about its own axis in a bolt and fixed with respect to its axial motion relative to the bolt by means of a shoulder. A control sleeve features on its front side a control pin, the surface of which is in contact with a control groove. In this firearm, the bolt handle is located on the front end of the breech block for construction-related reasons. This front position of the bolt handle complicates the handling and the fast function of the weapon.

DE 43 05 700 C1 likewise discloses a breech block for a firearm, in which the straight-pull lever is located directly above the trigger and can be conveniently handled due to this position. In this case, however, the lock is realized by means of an expandable sleeve that is not always reliable.

In all three above-described solutions, the control pieces of the respective breech blocks only have a comparatively short stroke that is defined by the position of the lever axis and the contact point with the control piece. The stroke only amounts to approximately 8-10 mm such that the lock can only be realized with an expandable sleeve, balls or a limited rotation by an angle, for example, of up to approximately 20°.

What is needed, therefore, is a breech block, particularly a straight-pull breech block for a firearm, which has a simple design, can be disassembled without tools, and ensures secure locking by means of a rotatable breech head.

SUMMARY OF THE INVENTION

The present invention relates to a breech block for firearms, particularly for repeating firearms, comprising a cartridge chamber, an external case and a bolt accommodated therein, wherein the bolt features a breech head in the region facing the cartridge chamber and a control piece is arranged within the bolt such that it can be axially displaced relative to the bolt and relative to the breech head, with said breech block furthermore comprising a bolt lever that is connected to the control piece such that the breech head is unlocked during a backward motion and locked during a forward motion of the bolt lever, wherein the bolt lever is pivotably mounted in the rear end region of the case and the bolt lever can be pivoted about an axis that extends eccentric to the longitudinal axis of the bolt.

The present invention is based on the objective of making available a breech block, particularly a straight-pull breech block for a firearm with the initially cited characteristics, which has a simple design, can be disassembled without tools and ensures secure locking by means of a rotatable breech head.

According to the invention, the control piece is connected to the bolt lever by means of an intermediate piece, which protrudes radially outward from the bolt, that the breech head is mounted in the bolt such that it is rotatable about its axis, and that the breech head is rotated by axially displacing the control piece.

In the breech block for firearms known from DE 196 08 872 C1, the breech head is not rotatable. The prior art indeed discloses straight-pull breech blocks for firearms, in which the breech head is mounted in a bolt such that it is rotatable about its own axis, for example, as described in aforementioned EP 0 784 194 A2. In these known breech blocks, however, only a comparatively small rotational angle is achieved for various construction-related reasons.

In the inventive solution, in contrast, the control piece is connected to the bolt lever by means of an intermediate piece. Since the pivoting axis of the bolt lever is arranged eccentric (referred to the longitudinal axis of the bolt) and the intermediate piece, on which the bolt lever engages, can be arranged on the side of the weapon lying opposite of the pivoting axis of the bolt lever and thereby still lies radially outward, the contact point of the bolt lever on the intermediate piece is also spaced apart from the pivoting axis of the bolt lever by comparatively large distance such that a long longitudinal stroke of the intermediate piece and therefore of the control piece is achieved during the pivoting motion of the bolt lever. This comparatively long longitudinal stroke of the control piece is then converted into a rotational motion of the breech head by a correspondingly large angle such that the breech head is securely locked.

According to a preferred embodiment of the invention, the intermediate piece is guided in at least one groove or recess in the wall of the case such that it can be displaced in the longitudinal direction. In this way, the intermediate piece is additionally guided and can be arranged so far radially outward that it not only extends radially outward beyond the bolt, but also at least partially beyond the case.

According to a preferred enhancement of the invention, the intermediate piece is also guided in an oblong hole of the bolt such that it can be displaced in the longitudinal direction.

According to a preferred enhancement of the invention, the bolt lever is pivotably connected to the intermediate piece by means of an axle element, the axis of which extends parallel to the pivoting axis of the bolt lever, wherein the axle element is in a top view arranged radially outside of the alignment of the bolt. Consequently, the axle element is spaced apart from the pivoting axis of the bolt lever by a comparatively large distance (in the transverse direction of the weapon) such that a long pivoting path is achieved when the bolt lever is actuated and the intermediate piece therefore is displaced over a long distance when the bolt lever is pulled back. This in turn leads to a long longitudinal stroke of the control piece and therefore to a large rotational angle of the breech head.

According to a preferred enhancement of the invention, a locking pin is laterally arranged on the radially outer side of the bolt approximately in its rear end region and cooperates with a spring-loaded rocker, wherein the rocker and the locking pin are released by the case when the bolt lever is pulled back and the locking pin then engages into a corresponding recess of the control piece such that its axial motion is blocked.

According to a preferred enhancement of the invention, a control pin, which approximately protrudes radially outward, is located in the front region of the control piece and engages into a control groove in a section of the breech head that concentrically accommodates the front region of the control piece.

According to a preferred enhancement of the invention, the intermediate piece is connected to the control piece by providing the intermediate piece with an extension or a tab that protrudes radially inward and thereby engages into a radial bore in the control piece.

According to a preferred enhancement of the invention, the axle pin, which serves as pivoting axis for the bolt lever, is mounted such that it can be pressed in in its axial direction, wherein the bolt lever is released by pressing in the axle pin and the firing pin assembly can be removed axially rearward.

According to a preferred enhancement of the invention, the axle element, by means of which the bolt lever is pivotably connected to the intermediate piece, engages into a transverse groove on the underside of the intermediate piece.

According to a preferred enhancement of the invention, the intermediate piece features on its upper side a groove, by means of which it is displaceably guided relative to a widened rear part of the bolt when the bolt lever is actuated in order to carry out a pivoting motion of the bolt lever.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

Exemplary embodiments of the present invention are described in greater detail below with reference to the attached drawings, wherein.

DETAILED DESCRIPTION

Figure 1:
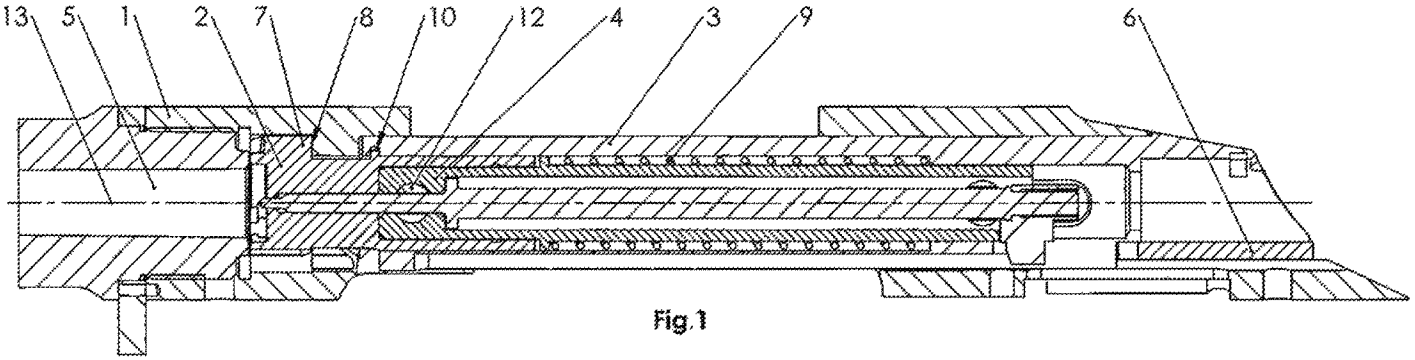
FIG. 1 shows a vertical longitudinal section drawn to scale through a breech block according to an exemplary embodiment of the present invention in the locked and cut-off position.

The basic design of the inventive breech block is initially described with reference to FIGS. 1 and 2. Both illustrations respectively show the breech block in the locked and cut-off position. The breech block consists of a straight-pull breech block that is arranged in an essentially tubular, cylindrical case 1 and the front breech head 2 of which is mounted in an also approximately cylindrical bolt 3 rotatably, but non-displaceably, wherein the bolt 3 is in turn coaxially accommodated in the cylindrical case. The front views according to FIGS. 7*a* and 7*b* also show that the breech head 2 features on its radially outer side locking elements 7 that are realized in the form of studs and can be engaged with and disengaged from corresponding locking elements 8 of the barrel or the case 1. On its rear side, the breech head 2 features at least one control groove 11 (see also FIGS. 6*a*, 6*b*) that has a constant or progressive incline.

The breech head 2 is fixed with respect to its axial motion relative to the bolt 3 by means of the shoulder 10. A control piece 4 is provided and mounted in the breech head 2 and in the case 3 in an axially displaceable fashion. In its front end region, the control piece 4 features a control pin 12, which extends radially outward and the surface of which is in contact with the control groove 11 of the breech head 2 (see also FIGS. 6*a* and 6*b*).

Figure 2:
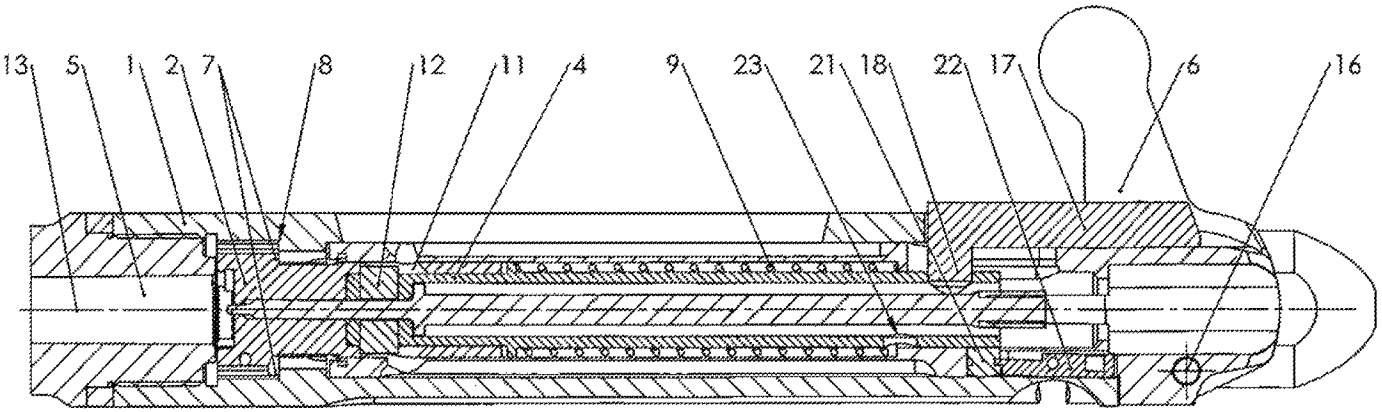
FIG. 2 shows a horizontal longitudinal section drawn to scale through a breech block according to an exemplary embodiment of the present invention in the locked and cut-off position.
Figure 4:
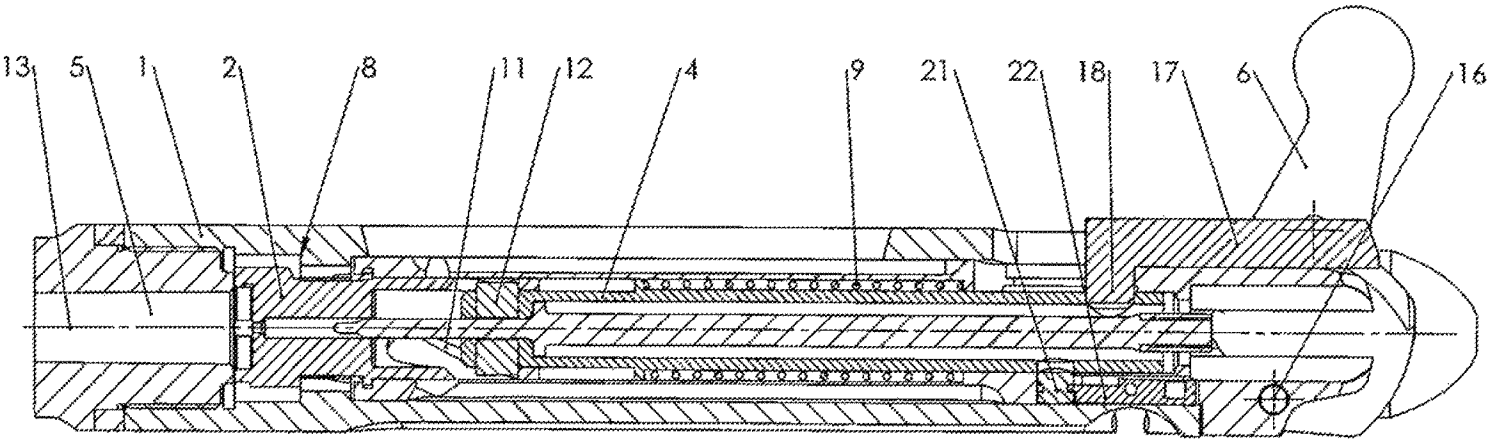
FIG. 4 shows a horizontal longitudinal section drawn to scale through the breech block in the unlocked position.
Figures 8A, 8B, 9A, 9B, 10:
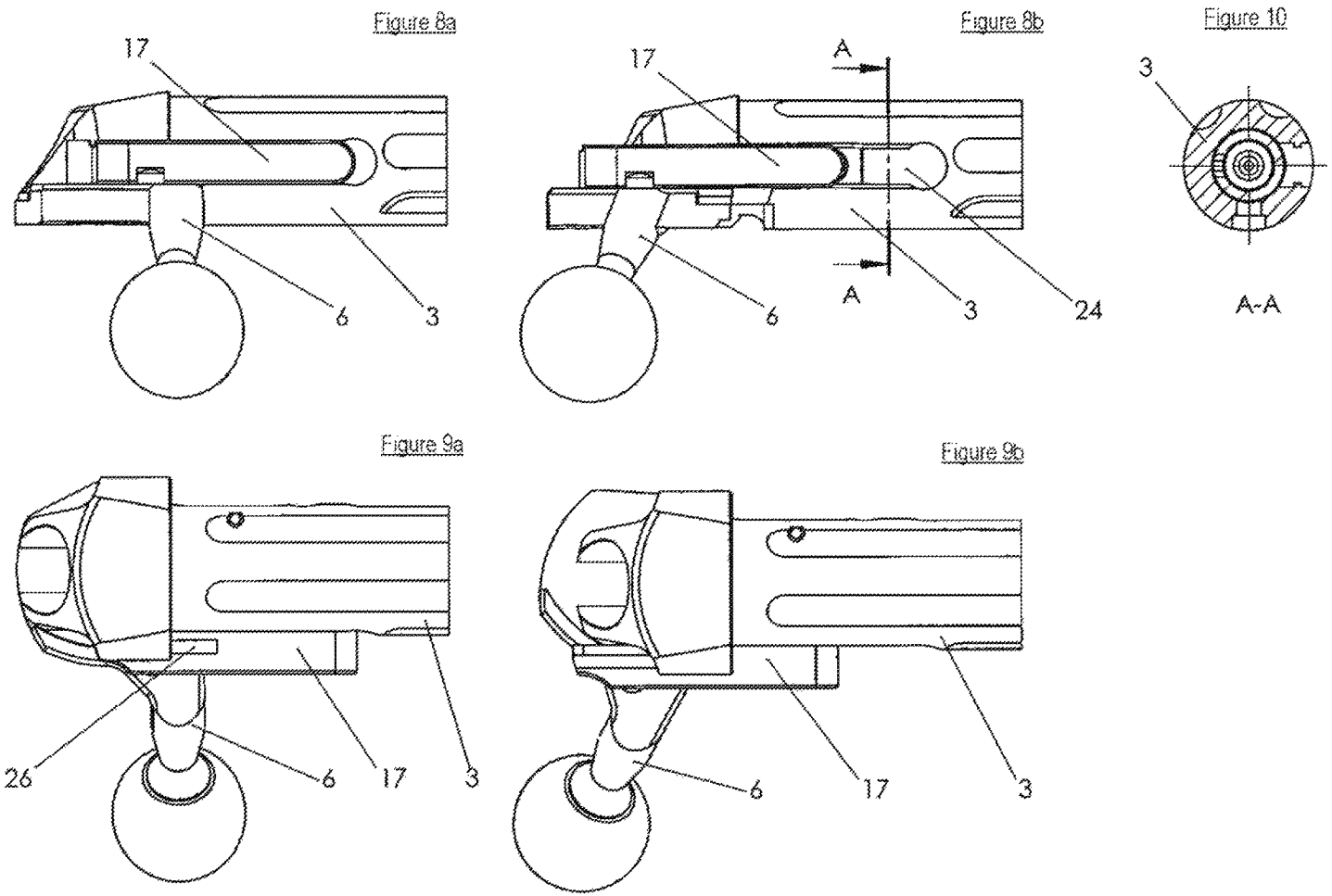
FIG. 8*a* shows a view drawn to scale of the bolt lever and the intermediate piece in the locked position.
FIG. 8*b* shows a view drawn to scale of the bolt lever and the intermediate piece in the unlocked position.
FIG. 9*a* shows a side view drawn to scale of the bolt lever and the intermediate piece according to FIG. 8*a*, which is turned by 90°.
FIG. 9*b* shows a side view drawn to scale of the bolt lever and the intermediate piece in the unlocked position according to FIG. 8*b*, which is turned by 90°.
FIG. 10 shows a cross section drawn to scale along the line A-A in FIG. 8*b;*
Figure 11A:
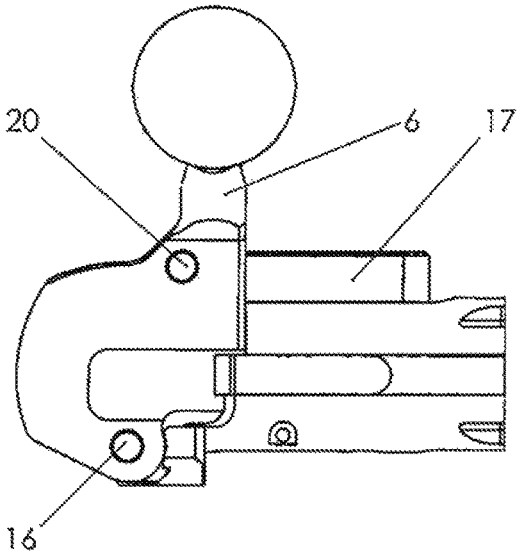
FIG. 11*a* shows a view drawn to scale of the breech block in the rear region with the bolt lever and the intermediate piece in the locked position, wherein the breech block according to FIG. 9*a* is illustrated from below in this figure.

FIGS. 2 and 4 show the bolt lever 6 that is mounted on the rear end of the bolt 3 such that it can be positively pivoted about an axle pin 16 (see also FIGS. 11*a, b*, 12). This allows a fast disassembly without tools. The control piece 4 is moved in the axial direction by means of an intermediate piece 17 connected thereto by pivoting the bolt lever 6 about the axle pin 16. The motion of the intermediate piece 17 can be gathered quite well by comparing FIGS. 8*a* and 8*b* on the one hand, as well as FIGS. 11*a* and 11*b* on the other hand.

Figure 16:
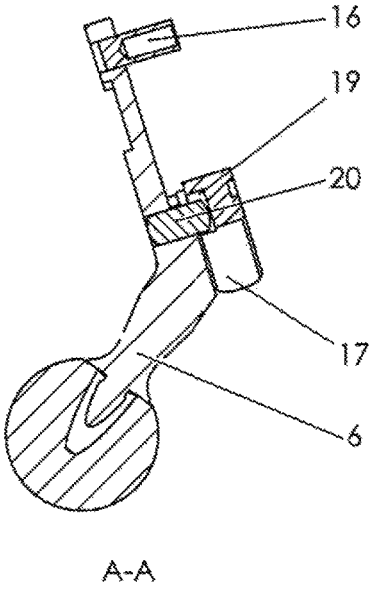
FIG. 16 shows a section drawn to scale along the line A-A in FIG. 15.

The intermediate piece 17 is mounted in the bolt 3 in an axially displaceable fashion and connected to the control piece 4 by means of the tab 18 (see FIGS. 2 and 4). On its rear end, the intermediate piece 17 is connected to the bolt lever 6 by means of the transverse groove 19 and the axle element 20 (FIG. 16).

A locking pin 21 with a spring-loaded rocker 22 is arranged on the rear end of the bolt 3, namely on the side of the bolt 3 that lies diametrically opposite of the intermediate piece 17 (see FIG. 2). This locking pin 21 engages into a recess 23 (see FIG. 2) when the bolt 3 is moved out of the case 1 while the weapon is repeated (see FIG. 4).

Figure 3:
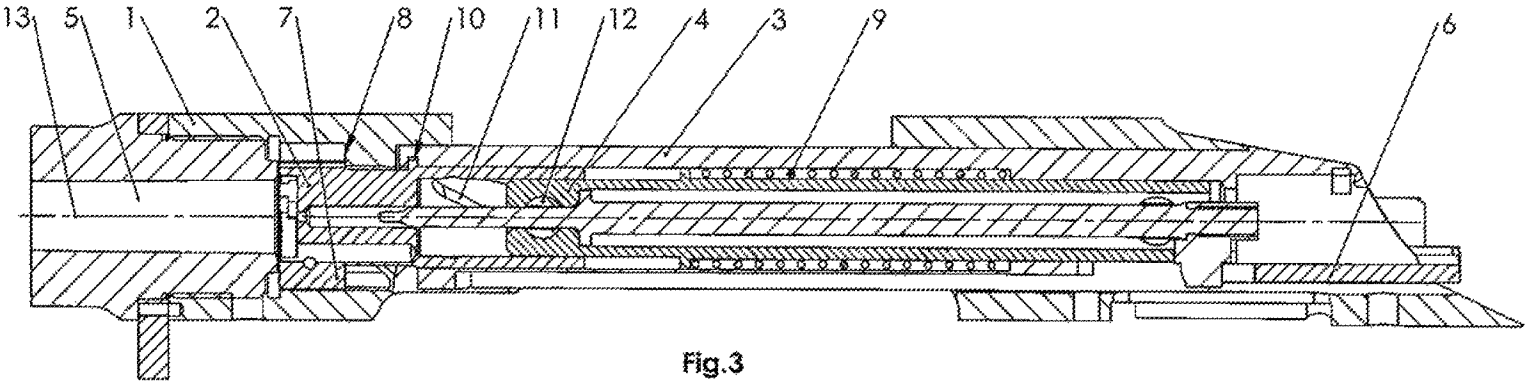
FIG. 3 shows a vertical longitudinal section drawn to scale through the breech block in the unlocked position.

The function of the inventive breech block is described in greater detail below. During the motion of the breech block into the locked and cut-off position illustrated in FIGS. 1 and 2, the bolt lever 6 is moved forward and pivoted such that the intermediate piece 17 and the control piece 4 are also moved into a front position. In order to open the breech block, the bolt lever 6 is pulled back such that the intermediate piece 17 and the control piece 4 connected thereto are also pulled back into the position illustrated in FIGS. 3 and 4. During the backward motion, the breech head 2 is rotated about its own axis 13 and thereby unlocked by means of the control groove 11 arranged in the breech head 2 and the control pin 12. In this respect, we also refer to FIGS. 6*a* and 6*b*, in which the control piece 4 is respectively illustrated in the front position and in the pulled-out rear position. The motion of the control pin 12 in the control groove 11 can be gathered quite well from these figures. Since the breech head 2 is fixed in the axial direction, it rotates about its axis when the control piece is pulled back. The two rotational positions of the breech head are also illustrated in FIGS. 7*a* and 7*b*, in which the breech head 2 is illustrated in the form of a front view.

Figure 5:
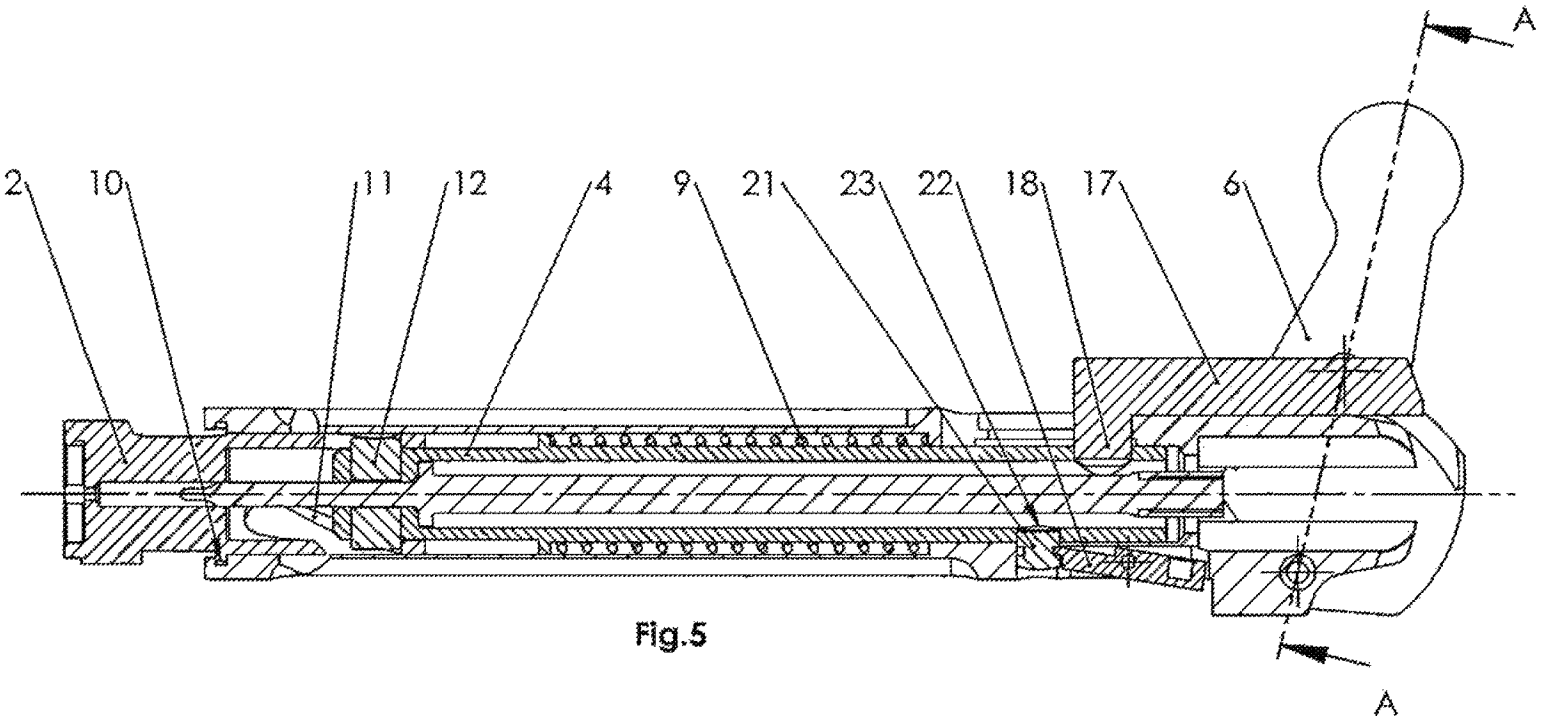
FIG. 5 shows a horizontal longitudinal section drawn to scale through the breech block in the unlocked position without case.

The rocker 22 and therefore the locking pin 22 are released from the case 1 as the bolt lever 6 is pulled back further (see FIG. 5). This means that the locking pin 21 engages into the corresponding recess of the control piece 4 and blocks its axial motion. The breech head 2 can now be axially pulled out of the case toward the rear together with the bolt 3 and the control piece 4. Subsequently, no rotational motion of the breech head 2 and no axial motion of the control piece 4 within the bolt 3 takes place.

When the bolt lever 6 and the breech head 2 are fixed in the unlocked position, the breech block can slide in an unobstructed fashion in order to thereby carry out the repeating process.

Figure 6:
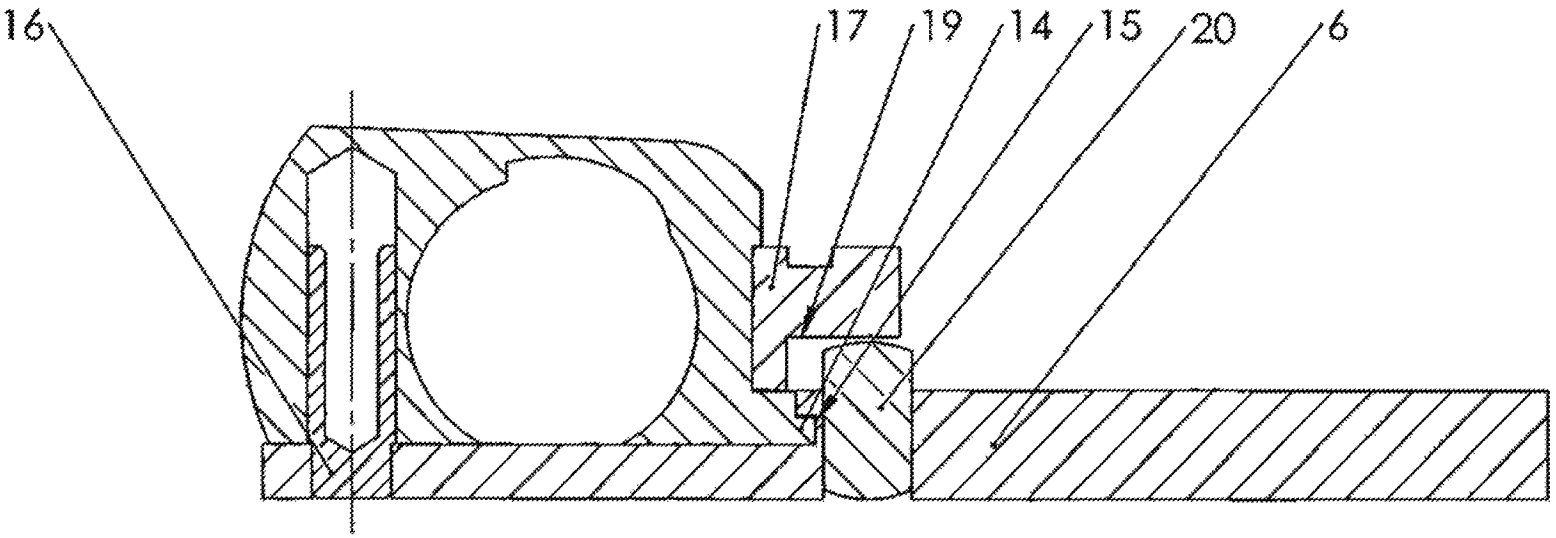
FIG. 6 is a longitudinal section drawn to scale through the breech block along the line indicted in FIG. 5 as A-A.

When the breech block is closed (FIG. 4), the rotational motion of the bolt lever 6 and therefore of the breech head 2 is not released until the rocker 22 has been pushed farther forward over the edge of the case 1 (see also FIG. 5 and FIG. 6).

The control piece 4 is pushed forward by the closing spring 9 such that the closing process is simplified and the breech head 2 is held in the locked position (see FIG. 2).

Figure 6A:
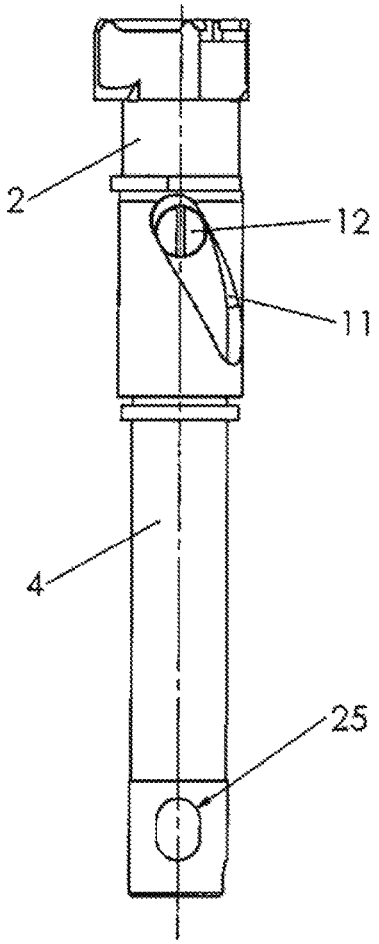
FIG. 6*a* shows a side view drawn to scale of the breech head and the control piece in the locked position.
Figure 6B:
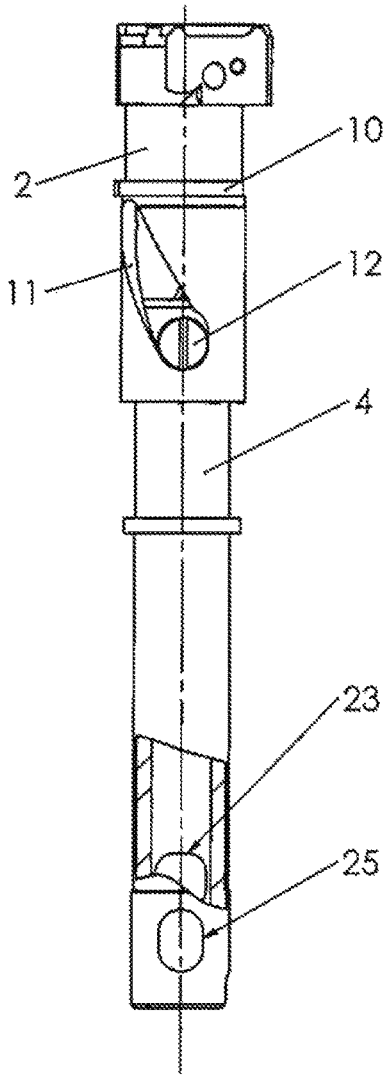
FIG. 6*b* shows a corresponding side view drawn to scale in the unlocked position.
Figure 7A:
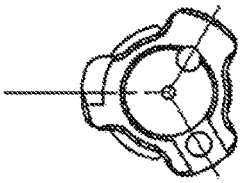
FIG. 7*a* shows a front view drawn to scale of the breech head of FIG. 6*a;*
Figure 7B:
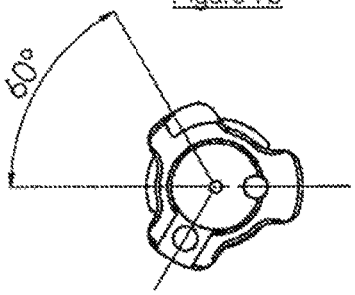
FIG. 7*b* shows a front view drawn to scale of the breech head of FIG. 6*b* in the unlocked position.

FIGS. 6*a* and 6*b* show the control piece 4 without the bolt 3, in which it is mounted in an axially displaceable fashion. The control groove 11 in the breech head 2 and the control pin 12 guided in this control groove 11 are illustrated quite well in these figures. If the control piece 4 is now moved rearward from the locked position according to FIG. 6*a* by means of the not-shown intermediate piece 17, the breech head carries out a rotational motion into the position illustrated in FIG. 6*b*. A comparison of these two figures clearly shows the comparatively long longitudinal stroke of the control piece 4. These two drawings also show the radial bore 25 of the control piece 4, into which the tab 18 (see FIG. 2) of the intermediate piece engages in order to produce the connection between the intermediate piece 17 and the control piece 4.

The front views according to FIGS. 7*a* and 7*b* show the magnitude of the rotational angle during the above-described locking process of the breech head 2, wherein the rotational angle of approximately 60° shown is significantly larger than in devices known from the prior art. FIGS. 7*a* and 7*b* furthermore show the contour of the breech head 2 in its end region, which features tabs, projections or the like and is shaped such that the breech head is locked in the position according to FIGS. 7*a*/6*a* whereas the breech head 2 positively fits into a correspondingly shaped inside contour in the case 1 and therefore can slide back into the case after its rotation into the position according to FIG. 7*b*. In this respect, we also refer to the respective locking elements 7, 8 of the breech head 2 and the case 1, which are exposed after the unlocking process in the illustrations according to FIGS. 3 and 4.

FIGS. 8*a* and 8*b* respectively show a side view of the rear region of the weapon, wherein these figures particularly show the connection between the intermediate piece 17 and the bolt lever 6, as well as the oblong hole 24 in the bolt, in which the intermediate piece 17 is guided during the first phase of the rearward motion of the bolt lever 6 until the breech head 2 is unlocked. During the second phase of the motion after the locking pin 21 has been released, the breech block with the bolt 3 moves out of the case 1 axially rearward and the intermediate piece 17 is then locked relative to the bolt 3.

FIGS. 9*a* and 9*b* show the respective side views of FIGS. 8*a* and 8*b*, wherein the weapon is illustrated from above in FIG. 9. According to this figure, the intermediate piece 17 features on its upper side a groove 26, by means of which it is displaceably guided relative to the rear part of the bolt when the bolt lever 6 is actuated in order to carry out its pivoting motion. Since the intermediate piece 17 is thusly guided in two regions that lie perpendicular to one another (once on the case 1 and once on the wider rear part of the bolt 3), it is captured on the weapon during its motion. The aforementioned widened rear part of the bolt 3 is realized in such a way that it flushly abuts on the rear end of the case 1 (see FIGS. 1 and 2).

Figure 11B:
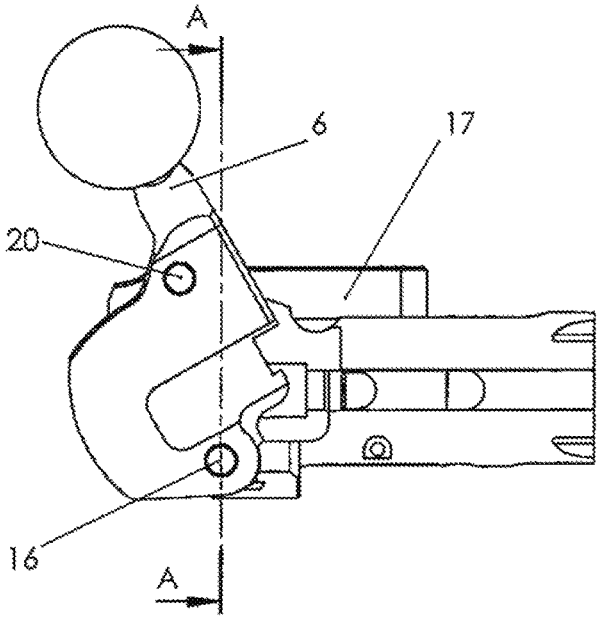
FIG. 11*b* shows a view drawn to scale of the bolt lever and the intermediate piece corresponding to FIG. 11*a*, however, in the unlocked position.
Figure 12:
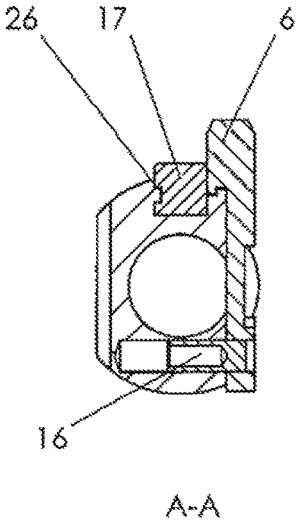
FIG. 12 shows a section drawn to scale through the illustration in FIG. 11*b* along the line A-A.

FIGS. 11*a* and 11*b* once again show the region with the bolt lever 6 and the intermediate piece 17 in the locked and in the unlocked position, wherein the bolt lever 6 is effectively illustrated from below in this case. These figures show the axle pin 16, about which the bolt lever 6 pivots, as well as the pin 20 that defines the pivoting point of the pivotable connection between the bolt lever 6 and the intermediate piece 17. FIG. 12 shows a section through the bolt lever 6, as well as the axle pin 16 and the groove 26 on the upper side of the intermediate piece 17.

Figure 13:
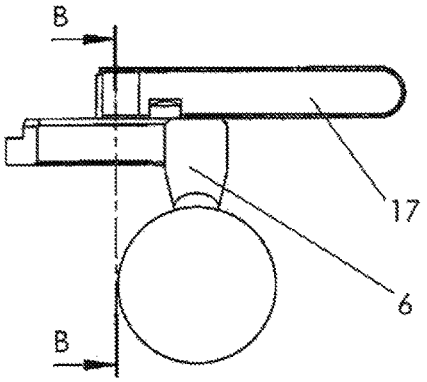
FIG. 13 shows a view drawn to scale of the bolt lever and the intermediate piece in a position similar to FIG. 8*a;*
Figure 14:
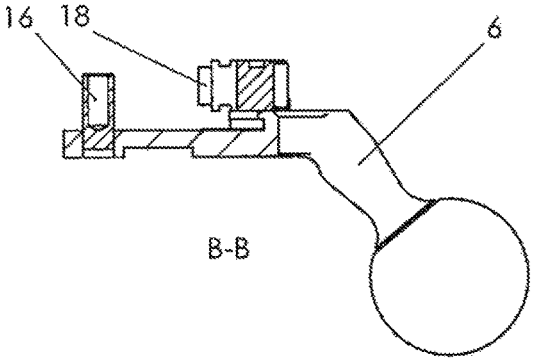
FIG. 14 shows a section drawn to scale along the line B-B in FIG. 13.
Figure 15:
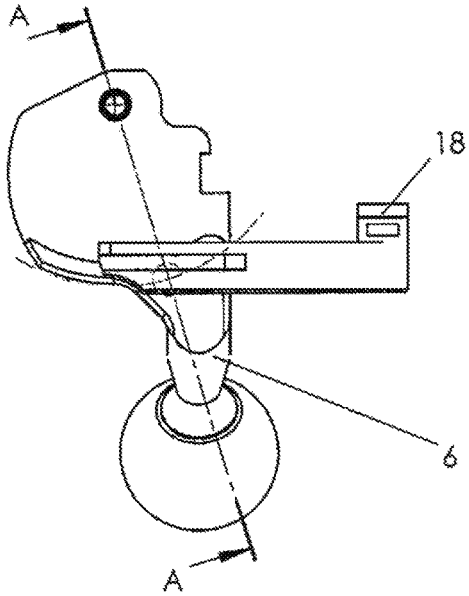
FIG. 15 shows a view drawn to scale of the bolt lever and the intermediate piece, which is turned by 90° referred to FIG. 13.

FIG. 13 shows the bolt lever 6 with the intermediate piece 17, wherein the sectional view according to FIG. 14 shows the bolt lever 6 with the axle pin 16 forming its pivoting axis. FIG. 14 furthermore shows the tab 18, by means of which the intermediate piece 17 is connected to the control piece 4. FIG. 15 basically shows a side view of FIG. 13 such that the bolt lever 6 is illustrated from below in this case. In the sectional view according to FIG. 16, the line of section extends through the axle pin 16 and through the pin 20 such that this figure shows how the bolt lever 6 is pivotably connected to the intermediate piece 17 by means of the pin 20.

REFERENCE LIST

Following are descriptive names associated with the corresponding item numbers as indicated in the accompanying drawings.

Item # Item Name
1 Case
2 Breech head
3 Bolt
4 Control piece
5 Cartridge chamber
6 Bolt lever
7 Locking elements
8 Locking elements
9 Closing spring
10 Shoulder
11 Control groove
12 Control pin
13 Axis
14 Shoulder
15 Groove
16 Axle pin
17 Intermediate piece
18 Tab
19 Transverse groove
20 Axle element
21 Locking pin
22 Rocker
23 Recess
24 Oblong hole
25 Radial bore
26 Groove The present invention is a breech block for firearms, particularly for repeating firearms, comprising a cartridge chamber, an external case (1) and a bolt (3) accommodated therein, wherein the bolt (3) features a breech head (2) in the region facing the cartridge chamber and a control piece (4) is arranged within the bolt (3) such that it can be axially displaced relative to the bolt (3) and relative to the breech head (2), with said breech block furthermore comprising a bolt lever (6) that is connected to the control piece (4) such that the breech head (2) is unlocked during a backward motion and locked during a forward motion of the bolt lever (6), and wherein the bolt lever (6) is pivotably mounted in the rear end region of the case (1) and the bolt lever can be pivoted about an axis that extends eccentric to the longitudinal axis of the bolt (3), characterized in that the control piece (4) is connected to the bolt lever (6) by means of an intermediate piece (17), which protrudes radially outward from the bolt, in that the breech head (2) is mounted in the bolt (3) such that it is rotatable about its axis (13), and in that the breech head (2) is rotated by axially displacing the control piece (4).

In embodiments, the intermediate piece is guided in at least one groove or recess in the wall of the case (1) such that it can be displaced in the longitudinal direction. And in some of these embodiments the intermediate piece (17) features on its upper side a groove (26), by means of which it is displaceably guided relative to a widened rear part of the bolt (3) when the bolt lever is actuated in order to carry out a pivoting motion of the bolt lever (6).

In embodiments, the intermediate piece (17) is guided in an oblong hole (24) of the bolt (3) such that it can be displaced in the longitudinal direction.

In various embodiments, the bolt lever (6) is pivotably connected to the intermediate piece by means of an axle element (20), the axis of which extends parallel to the pivoting axis (16) of the bolt lever (6), wherein the axle element (20) is in a top view arranged radially outside of the alignment of the bolt. In some of these embodiments, the axle pin (16) is mounted such that it can be pressed in in its axial direction, wherein the bolt lever (6) is released by pressing in the axle pin and the firing pin assembly can be removed axially rearward. In other of these embodiments, the axle element (20), by means of which the bolt lever (6) is pivotably connected to the intermediate piece (17), engages into a transverse groove (19) on the underside of the intermediate piece (17).

In certain embodiments, a locking pin (21) is laterally arranged on the radially outer side of the bolt (3) approximately in its rear end region and cooperates with a spring-loaded rocker (22), wherein the rocker (22) and the locking pin (21) are released by the case (1) when the bolt lever (6) is pulled back and the locking pin (21) then engages into a corresponding recess (23) of the control piece (4) such that its axial motion is blocked.

In embodiments, a control pin (12), which approximately protrudes radially outward, is located in the front region of the control piece (4) and engages into a control groove (11) in a section of the breech head (2) that concentrically accommodates the front region of the control piece (4).

And in various embodiments the intermediate piece (17) is connected to the control piece (4) by providing the intermediate piece with an extension or a tab (18) that protrudes radially inward and thereby engages into a radial bore (25) in the control piece (4).

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

The characteristics disclosed in the dependent claims below concern preferred enhancements of the inventive solution. Other advantages of the invention can be gathered from the detailed description that appears above.

What is claimed is:

1. A breech block for firearms, comprising:

a cartridge chamber;

an external case;

a bolt accommodated in the external case, wherein the bolt features a breech head in a region facing the cartridge chamber;

a control piece arranged within the bolt such that it can be axially displaced relative to the bolt and relative to the breech head; and a bolt lever connected to the control piece such that the breech head is unlocked during a backward motion and locked during a forward motion of the bolt lever, and wherein the bolt lever is pivotably mounted in the rear end region of the case and the bolt lever can be pivoted about an axis that extends eccentric to a longitudinal axis of the bolt, the control piece being connected to the bolt lever by means of an intermediate piece, which protrudes radially outward from the bolt, in that the breech head is mounted in the bolt such that it is rotatable about its axis, and in that the breech head is rotated by axially displacing the control piece.

2. The breech block for firearms according to claim 1, characterized in that the intermediate piece is guided in at least one groove or recess in the wall of the case such that it can be displaced in the longitudinal direction.

3. The breech block according to claim 2, characterized in that the intermediate piece features on its upper side a groove by means of which it is displaceably guided relative to a widened rear part of the bolt when the bolt lever is actuated in order to carry out a pivoting motion of the bolt lever.

4. The breech block for firearms according to claim 1, characterized in that the intermediate piece is guided in an oblong hole of the bolt such that it can be displaced in the longitudinal direction.

5. The breech block according to claim 1, characterized in that the bolt lever is pivotably connected to the intermediate piece by means of an axle element the axis of which extends parallel to the pivoting axis of the bolt lever, wherein the axle element is in a top view arranged radially outside of the alignment of the bolt.

6. The breech block according to claim 5, characterized in that the bolt lever is pivotably mounted in the rear end region of the case by an axle pin that is mounted such that it can be pressed in in its axial direction, wherein the bolt lever is released by pressing in the axle pin and the firing pin assembly can be removed axially rearward.

7. The breech block according to claim 5, characterized in that the axle element by means of which the bolt lever is pivotably connected to the intermediate piece engages into a transverse groove on the underside of the intermediate piece.

8. The breech block according to claim 5, wherein the pivoting axis of the bolt lever and the axle element are arranged in a top view on opposing sides of the alignment of the bolt.

9. The breech block according to claim 1, characterized in that a locking pin is laterally arranged on the radially outer side of the bolt approximately in its rear end region and cooperates with a spring-loaded rocker, wherein the rocker and the locking pin are released by the case when the bolt lever is pulled back and the locking pin then engages into a corresponding recess of the control piece such that its axial motion is blocked.

10. The breech block according to claim 1, characterized in that a control pin, which protrudes outward in a direction that is approximately radial, is located in the front region of the control piece and engages into a control groove in a section of the breech head that concentrically accommodates the front region of the control piece.

11. The breech block according to claim 1, characterized in that the intermediate piece is connected to the control piece by providing the intermediate piece with an extension or a tab that protrudes radially inward and thereby engages into a radial bore in the control piece.

* * * * *